US005317881A

United States Patent [19]

Colvin

[11] Patent Number: 5,317,881

[45] Date of Patent: Jun. 7, 1994

[54] APPARATUS FOR DISPLAYING MATERIAL UNDER REFRIGERATED CONDITIONS

[75] Inventor: Leonard F. Colvin, Ascot, United Kingdom

[73] Assignee: Colbrook Equipment Limited, Alton, United Kingdom

[21] Appl. No.: 910,338

[22] PCT Filed: Jan. 18, 1991

[86] PCT No.: PCT/GB91/00078

§ 371 Date: Jul. 20, 1992

§ 102(e) Date: Jul. 20, 1992

[87] PCT Pub. No.: WO91/10388

PCT Pub. Date: Jul. 25, 1991

[30] Foreign Application Priority Data

Jan. 19, 1990 [GB] United Kingdom ..... 9001225

[51] Int. Cl.[5] ..... A47F 3/04

[52] U.S. Cl. ..... 62/209; 62/256

[58] Field of Search ..... 62/186, 208, 255, 256, 62/209, 247; 236/78 B

[56] References Cited

U.S. PATENT DOCUMENTS

| | | | |
|---|---|---|---|
| 2,794,325 | 6/1957 | Shearer | 62/253 |
| 2,932,955 | 4/1960 | Hargrave et al. | 62/255 |
| 3,018,712 | 1/1962 | Wacker | 236/78 B X |
| 3,119,241 | 1/1964 | Wile | 62/254 |
| 3,698,205 | 10/1972 | Perez | 62/256 |
| 4,117,698 | 10/1978 | Vogel | 62/256 |
| 4,738,806 | 4/1988 | Noma et al. | 62/247 X |

FOREIGN PATENT DOCUMENTS

| | | |
|---|---|---|
| 159004 | 8/1990 | Denmark . |
| 0361289 | 4/1990 | European Pat. Off. . |
| 2923611 | 12/1980 | Fed. Rep. of Germany . |

*Primary Examiner*—William E. Tapolcai

*Attorney, Agent, or Firm*—Florence U. Reynolds

[57] ABSTRACT

In order to cool food in a display compartment, a cold air stream is generated by refrigeration means, preferably a fan, an evaporator and a condenser, and is passed through the display compartment from its inlet to its outlet. The air temperatures at the inlet and outlet may be sensed by sensors in which case control means are responsive to a signal from the output of both the sensors and control the operation of the refrigeration means to maintain the air temperature in the display compartment within a narrow predetermined range.

20 Claims, 4 Drawing Sheets 24
23
22
10
28
27
25
34
34
34
20
34
26
36
30
34
34
38
40
38
16
12
18
14
14

APPARATUS FOR DISPLAYING MATERIAL UNDER REFRIGERATED CONDITIONS

BACKGROUND OF THE INVENTION

This invention relates to apparatus for displaying food or other material under refrigerated conditions.

The installations currently used for the refrigerated display of food, for example in a self-service display, tend to suffer from uneven temperature distribution in the display compartment, leading to food in some areas of the display compartment being at undesirably high temperatures and food in other areas being at undesirably low temperatures.

An aim of the present invention is to minimize this drawback.

SUMMARY OF THE INVENTION

According to the present invention, there is provided apparatus for displaying material under refrigerated conditions, comprising a display compartment, means for generating a stream of cooled air which passes through the display compartment, an air inlet sensor for sensing the temperature of the air at the inlet to the display compartment, an air outlet sensor for sensing the temperature of the air at the outlet from the display compartment, and control means responsive to the sensors for controlling the operation of the refrigeration means, thereby maintaining the air temperature in the display compartment within a narrow predetermined range.

Desirably the control means is responsive to the computed mean of the inlet and outlet temperatures, the computed mean temperature corresponding approximately to the actual temperature approximately at the mid-point between the inlet and outlet.

Preferably the refrigeration means includes a condenser, an evaporator and a fan. In that case preferably the fan is a centrifugal fan and is located upstream of the evaporator so that the air stream in the vicinity of the evaporator is slightly pressurized. The fan may then be located near the outlet from the display compartment and in communication with it so that the air follows a closed circuit. Preferably again the fan and the configuration of the display compartment are such that an evenly distributed laminar air flow is achieved. If desired, a further fan may be located downstream of the evaporator to drive a branch airstream to a refrigerated storage compartment.

Conventional refrigerated display installations have typically been run with an average temperature in the display compartment of +10° C. With the current concern over the bacterial contamination of food, such a temperature is not now regarded as sufficiently low, and it is desirable, and may in the future even be necessary, to operate refrigerated display installations at a temperature as low as +5° C. However, such relatively low temperature operation will exacerbate the disadvantage suffered by conventional installations which tend to deposit moisture on the evaporator, thus dehumidifying the air passing over the displayed food which consequently becomes dehydrated. Moreover, the consequent accumulation of ice on the evaporator leads to inefficient refrigeration and the need for more frequent de-frosting.

Preferably, in an apparatus in accordance with the present invention in which the refrigeration means includes a condenser, an evaporator and a fan, the evaporator has a large surface area, for example at least twice that of a conventional area in the case of a gravity fed unit, allowing it to be operated at a temperature such that moisture is retained in the air stream. The humidity of the air stream in the display compartment may thereby be increased by from 10 to 20%, typically about 15%, with respect to ambient relative humidity (RH). The evaporator may comprise a conventional coil, in which case the air flow over the evaporator may be so widely distributed that the coil never becomes blocked. The higher operating temperature reduces the amount of defrosting necessary. The fan speed may be so controlled as to permit automatic air flow defrosting without the need for heaters, thus allowing the temperature of the air flow to be kept at a low level during the defrosting cycle.

There may be, downstream of the refrigeration means, continuous humidification means, for example a humidifier operating by injecting a fine, electronically-created fresh water mist into the air stream. Not only does the humidifier allow the relative humidity (RH) in the display compartment to be maintained at a desired level, for example 80% RH, or even 85% RH, within a range of, for example, ±0.1–1.0%, but the visual effect of the misting is attractive to customers. Desirably the humidifying means includes water softening and cleanse dumping systems.

Additional preferred features of apparatus according to the invention include a lift-out tray in the display compartment; pull-out storage drawers located beneath the display compartment; an air intake which is easily removable to allow access to the condenser, the condenser being arranged to be pulled out for service; and access to a condensate drip tray.

BRIEF DESCRIPTION OF THE DRAWINGS

An embodiment of the invention will now be described, by way of example, with reference to the accompanying drawings in which.

DETAILED DESCRIPTION

Figure 1:
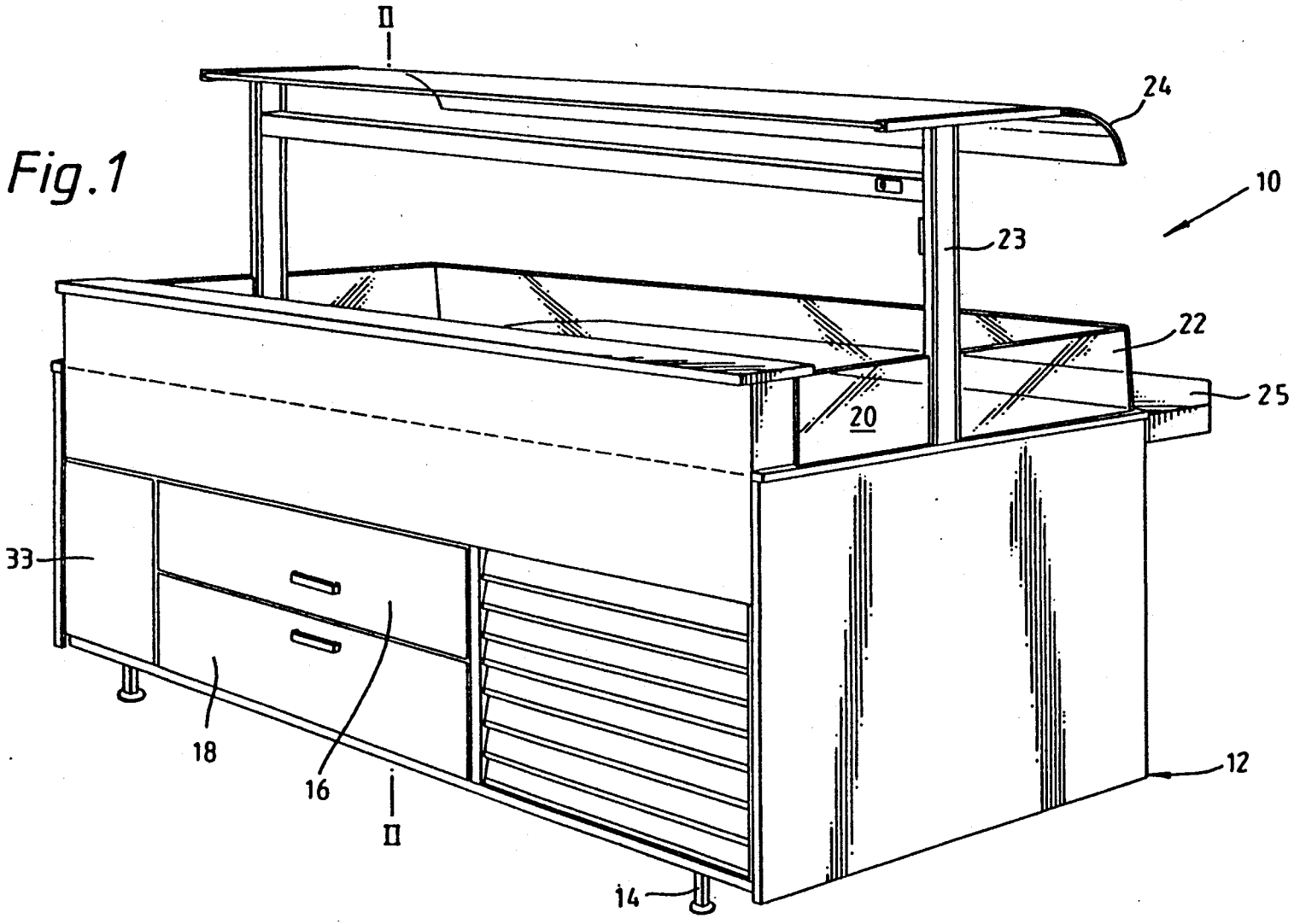
FIG. 1 is a rear perspective view of refrigerated display apparatus according to the invention.
Figure 2:
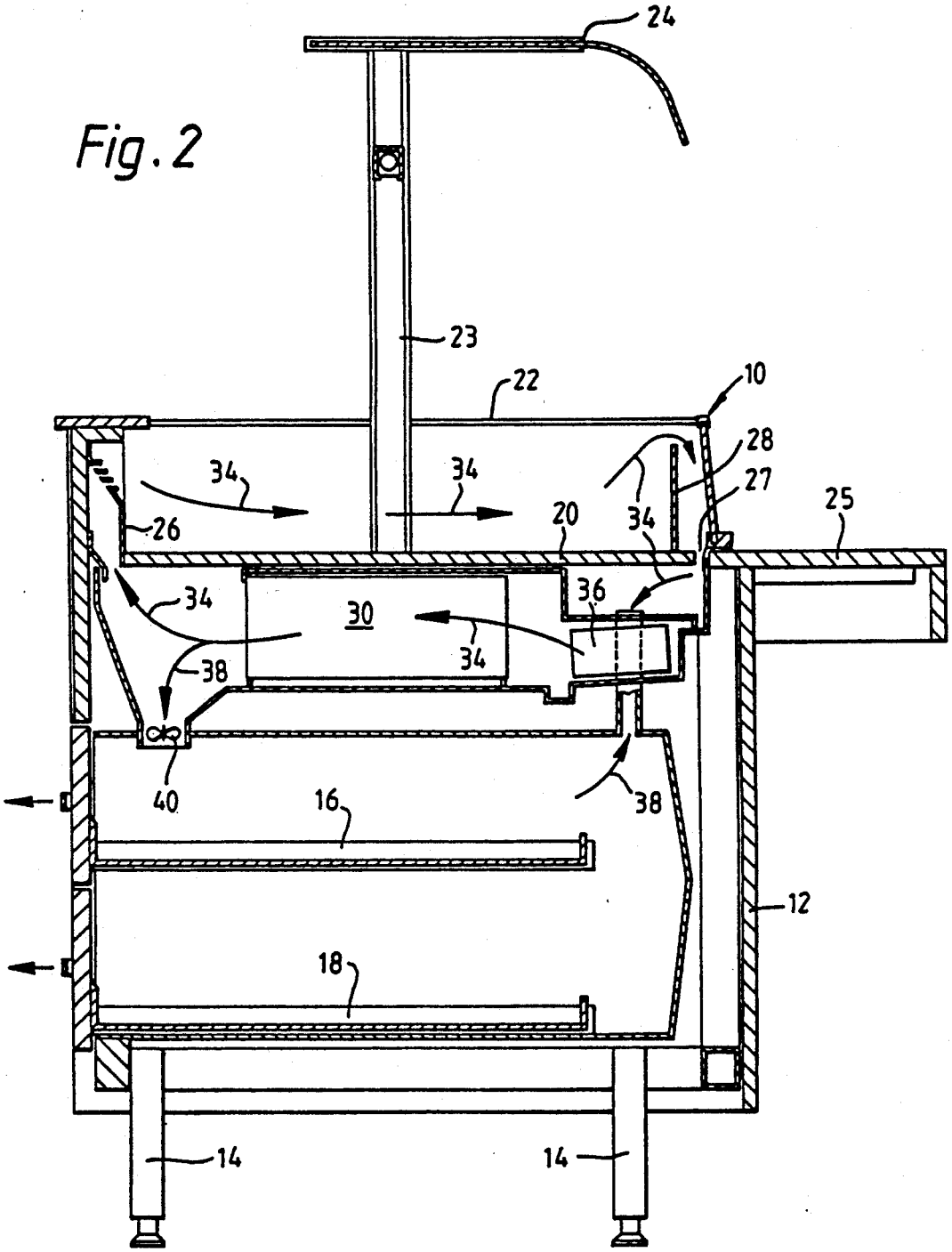
FIG. 2 is a section on the line II—II in FIG. 1.
Figure 3:
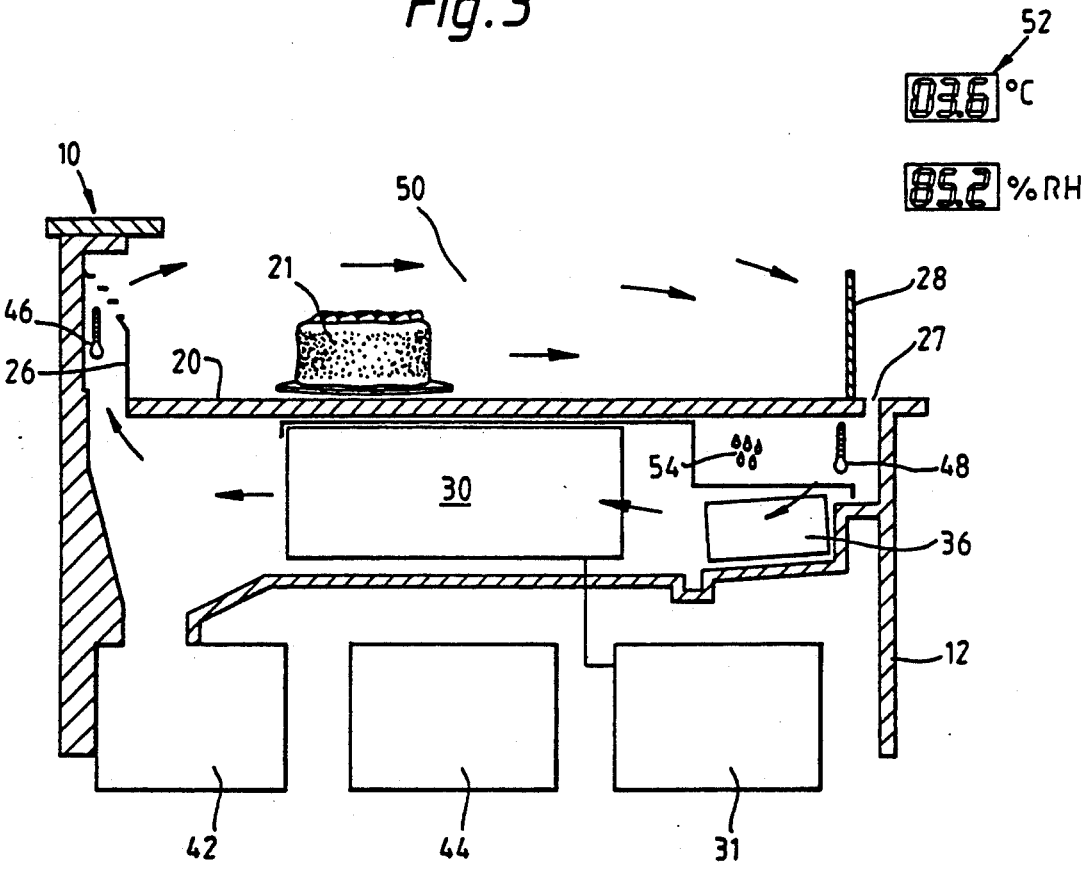
FIG. 3 is a further diagrammatic section illustrating the position of various functional units.
Figure 4:
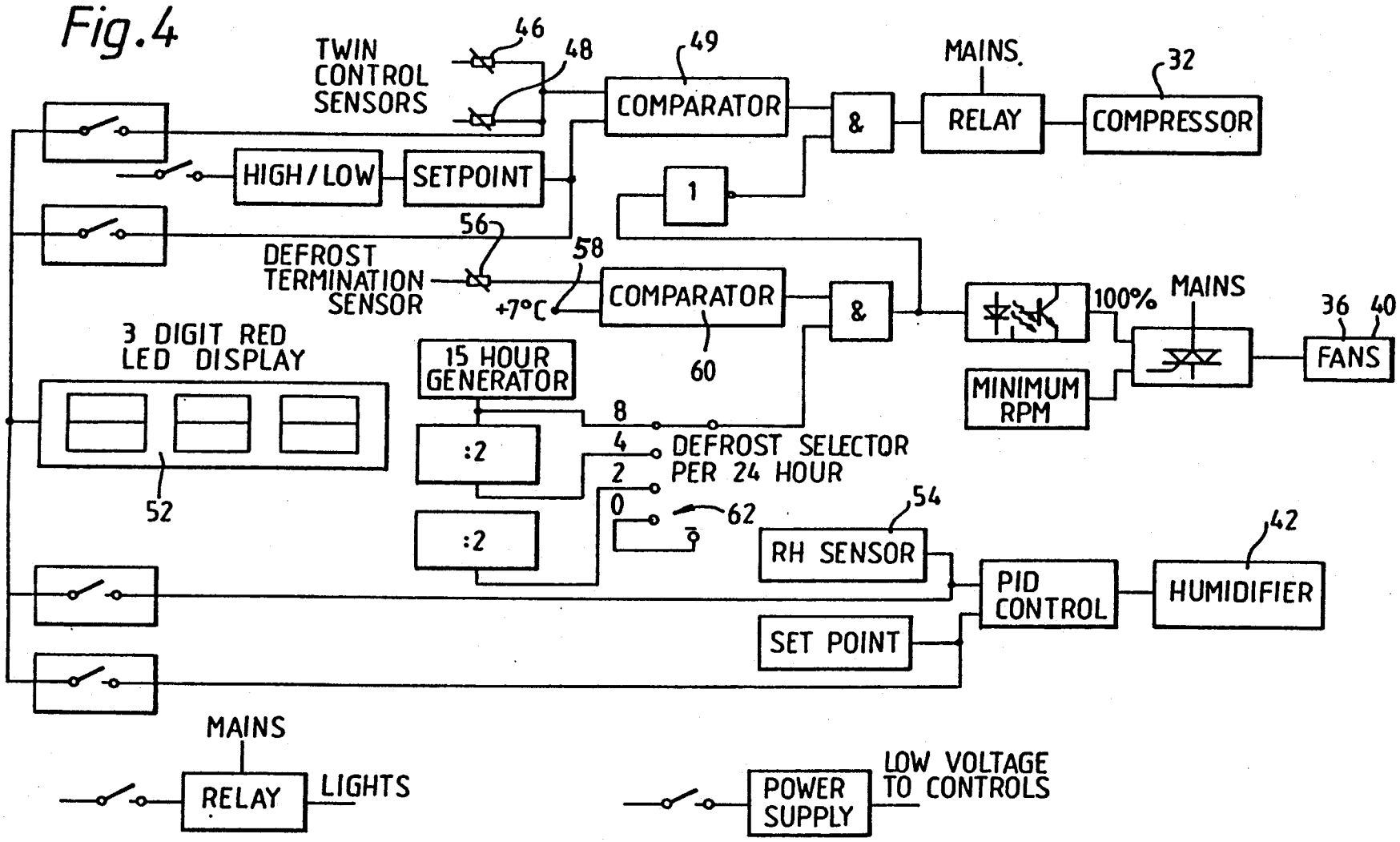
FIG. 4 is a simplified block circuit diagram of the electronic control system.

As shown in FIGS. 1, 2 and 3, a refrigerated display unit 10 comprises a cabinet 12 mounted on feet 14 and having two refrigerated storage drawers 16,18 and a display compartment comprising a lift-out display tray 20, supporting food 21, and a transparent frame 22. Above the tray 20 there is supported by pillars 23 a canopy 24, and on the front of the cabinet 12 is mounted a tray counter 25. The display tray 20 has an air inlet 26 and an air outlet 27, near which is located a baffle plate 28.

Mounted below the display tray 20 is an evaporator 30, of the coil type, connected to a refrigeration condensing unit 31 which is accessible for cleaning via a drop-down louvred air intake 32, and which can be easily pulled out of the cabinet 12 for service. Access to a condensate drip tray (not shown) is gained through a hinged panel 33.

Air in a closed circuit passes through a centrifugal fan 36, upstream of the evaporator 30, through the evaporator 30, over the display tray 20 and back to the fan 36, as indicated by arrows 34. The baffle plate 28 allows cold air in the display tray to build up to a predetermined height. A branch stream is driven downwardly over the drawers 16,18 by a fan 40 downstream of the evaporator 30, as indicated by arrows 38. Above the fan 40 is positioned a guard (not shown) to prevent food being placed immediately thereabove and thus stopping the circulation of air to the drawers 16. A humidification unit 42 is arranged to inject a fine mist of softened water into the air leaving the evaporator 30.

The electronic control system illustrated in FIG. 3 is largely centralized in an electronic control unit 44 (see FIG. 2) and also includes an air inlet temperature sensor 46 and an air outlet temperature sensor 48 for sensing the air temperatures at the inlet 26 and the outlet 27 of the display compartment. An associated display 52 displays the mean of the inlet and outlet temperatures as computed by the comparator 49 to give the temperature approximately at the mid-point 50. A relative humidity sensor 54 is arranged to give an RH read-out also on the display 52. Moreover, the control system is arranged to control the speed of the fans 36 and 40 and the operation of the refrigeration system via a compressor 32; and also the defrost cycles through sensors 56,58, comparator 60 and defrost selector 62. Additionally, the control system controls the humidifier 42 and its associated water treatment systems, and cabinet lighting.

By monitoring the computed mid-point temperature to ±0.1° C. the control system enables the temperature range at the rear of the tray 20 to be controlled to ±1.5° C.; at the middle to ±1° C.; and better than ±2° C. at the front. Moreover, the control system allows a choice of mid-point temperatures of +5° or +8° C., and a choice of humidity settings up to 85% RH.

From the foregoing it will be appreciated that the above-described refrigerated display unit 10 offers a wide variety of improvements over existing units, in particular the capability of maintaining a large open food display at a temperature not exceeding +5° C. over the height of the food.

I claim:

1. An apparatus for displaying material under refrigerated conditions, comprising a delay compartment, refrigeration means for generating a stream of cooled air which passes through the display compartment, an air inlet sensor for sensing the temperature of the air at the inlet to the display compartment, an air outlet sensor for sensing the temperature of the air at the outlet from the display compartment, and control means responsive to a signal derived from the output of both the sensors for controlling the operation of the refrigeration means thereby maintaining the air temperature in the display compartment within a narrow predetermined range.

2. The apparatus according to claim 1, in which the control means is responsive to the computed mean of the temperatures at the inlet and the outlet of the display compartment.

3. The apparatus according to claim 2, in which the refrigeration means comprises a condenser, an evaporator and a fan which is located upstream of the evaporator.

4. The apparatus according to claim 3, further comprising a fan downstream of the evaporator to drive a refrigerated air stream to a refrigerated storage compartment.

5. The apparatus according to claim 3, in which the evaporator has a surface area large enough to allow it to be operated at a temperature at which moisture is retained in the air stream.

6. The apparatus according to claim 5, in which the surface area of the evaporator exceeds more than about 10.3 $m^2$ per meter run.

7. The apparatus according to claim 1, in which continuous humidification means lie downstream of the refrigeration means and are arranged to inject a fine fresh water mist into the air stream.

8. The apparatus according to claim 3, further comprising a fan downstream of the evaporator to drive a refrigerated air stream to a refrigerated storage compartment.

9. The apparatus according to claim 2, in which the evaporator has a surface area large enough to allow it to be operated at a temperature at which moisture is retained in the air stream.

10. The apparatus according to claim 3, in which the evaporator has a surface area large enough to allow it to be operated at a temperature at which moisture is retained in the air stream.

11. The apparatus according to claim 4, in which the evaporator has a surface area large enough to allow it to be operated at a temperature at which moisture is retained in the air stream.

12. The apparatus according to claim 9, in which the surface area of the evaporator exceeds more than about 10.3 $m^2$ per meter run.

13. The apparatus according to claim 10, in which the surface area of the evaporator exceeds more than about 10.3 $m^2$ per meter run.

14. The apparatus according to claim 11, in which the surface area of the evaporator exceeds more than about 10.3 $m^2$ per meter run.

15. The apparatus according to claim 1, in which continuous humidification means lie downstream of the refrigeration means and are arranged to inject a fine fresh water mist into the air stream.

16. The apparatus according to claim 3, in which continuous humidification means lie downstream of the refrigeration means and are arranged to inject a fine fresh water mist into the air stream.

17. The apparatus according to claim 4, in which continuous humidification means lie downstream of the refrigeration means and are arranged to inject a fine fresh water mist into the air stream.

18. The apparatus according to claim 5, in which continuous humidification means lie downstream of the refrigeration means and are arranged to inject a fine fresh water mist into the air stream.

19. The apparatus according to claim 6, in which continuous humidification means lie downstream of the refrigeration means and are arranged to inject a fine fresh water mist into the air stream.

20. The apparatus according to claim 8, in which continuous humidification means lie downstream of the refrigeration means and are arranged to inject a fine fresh water mist into the air stream.

* * * * *